United States Patent [19]

Yukawa et al.

[11] 4,372,674

[45] Feb. 8, 1983

[54] COPYING MACHINE HAVING DETECTORS FOR THE BACKGROUND COLOR AND DENSITY OF THE ORIGINAL

[75] Inventors: Koji Yukawa; Masayuki Miyazaki; Takashi Murahashi, all of Hachioji, Japan

[73] Assignee: Konishiroku Photo Industry Co., Ltd., Tokyo, Japan

[21] Appl. No.: 200,977

[22] Filed: Oct. 27, 1980

[30] Foreign Application Priority Data

Oct. 29, 1979 [JP] Japan ..... 54-140262
Nov. 7, 1979 [JP] Japan ..... 54-143949

[51] Int. Cl.[3] ..... G03G 15/00
[52] U.S. Cl. ..... 355/14 D; 355/14 E; 118/691
[58] Field of Search ..... 355/14 D, 14 E; 118/668, 670, 679, 688, 689, 691

[56] References Cited

U.S. PATENT DOCUMENTS

| | | | |
|---|---|---|---|
| 2,956,487 | 10/1960 | Giaimo, Jr. | 355/14 D |
| 3,876,106 | 4/1975 | Powell et al. | 118/691 X |
| 4,025,184 | 5/1977 | Mochizuki | 355/14 D X |
| 4,043,293 | 8/1977 | Ruckdeschel | 118/691 |
| 4,087,171 | 5/1978 | Yano | 355/14 E X |
| 4,111,151 | 9/1978 | Ruckdeschel | 118/691 |
| 4,153,364 | 5/1979 | Suzuki et al. | 355/14 E |
| 4,239,374 | 12/1980 | Tatsumi et al. | 35/14 D X |

*Primary Examiner*—Gene Z. Rubinson
*Assistant Examiner*—Richard M. Moose
*Attorney, Agent, or Firm*—Linda G. Bierman; Jordan B. Bierman

[57] ABSTRACT

An apparatus for facilitating creation of an improved quality reproduction of an original to be copied includes a first sensor for producing a signal in accordance with the density of the background or nonimage are of the original, a second sensor for producing a signal in accordance with the color of its background, and electronic circuit means for generating a bias voltage based on the sensed density and color of the background of the original for application to a developing apparatus.

2 Claims, 5 Drawing Figures

COPYING MACHINE HAVING DETECTORS FOR THE BACKGROUND COLOR AND DENSITY OF THE ORIGINAL

BACKGROUND OF THE INVENTION

1. Field of the Invention

The present invention relates to a copying machine having detectors for the color and density of the nonimage or background area of an original placed on the copy board.

2. Description of the Prior Art

In a conventional electrophotographic copying machine, many factors influence the copy quality of the copied image. The influence on copy quality caused by the density of the background of the original to be copied is particularly great and it has thus been necessary to manually adjust the exposure length or the developing bias voltage in accordance with the background density. However, such manual adjustment is extremely troublesome and copying efficiency is low; therefore, to automate this, an effective method wherein the density of background colors (i.e. the nonimage or non-information area) of the original is automatically detected and an appropriate developing bias voltage corresponding to the detected density is impressed on the developing device was studied.

As an example of such a copying machine, reference is made to Japanese Laid-Open Patent Publication No. 95030/1978. According to its disclosure, a light receiving element with a minute light receiving area is arranged in or near the path of the copying light of the copying machine and the detected output corresponding to the background density of the original is measured; the developing bias voltage is automatically controlled on the basis of the recognized one-to-one correspondence between said detected output and an appropriate developing bias voltage.

In such a detecting method for background density when the surface or background of the original is colored, said detected output produced from a light receiving element varies in accordance with both the color and the density and, as a consequence, reliance on a strict one-to-one correspondence with an appropriate developing bias voltage may be misplaced. Of further significance is the difference in the color sensitivity of the photosensitive body or member. These factors cause great inconvenience in that the kinds of originals with which an appropriate developing bias voltage can conventionally be properly selected are extremely limited.

SUMMARY OF THE INVENTION

The primary object of the present invention is to provide a copying machine having a background color detecting means for the original to solve the aforesaid problem and, more specifically, to provide a copying machine having a light projecting means to illuminate the original to be copied, a light receiving part to receive the light reflected from the surface of the original, and a background color detecting device for the original wherein the color and density of its background are detected by the wavelength and amount of reflected light.

That is, in the background detecting device for an original according to the present invention, an extremely delicate detection of the background characteristics of the original is advantageously possible (unlike a conventional detecting device which has been applied to extremely limited originals) by utilizing a property of the detecting element. Such property makes it possible to obtain a signal proportional to the wavelength of light incident thereon, to detect the kinds of background color of the original, and to detect light and shade (or density) of the background of the original by a conventional photoelectric converter. It makes it further possible to determine, based upon the two detected signals, the magnitude of developing bias voltage that is in one-to-one correspondence with the relevant background characteristics of the original. In this case, it is of course an important factor to further consider the color sensitivity of the photosensitive body to be used.

DETAILED DESCRIPTION OF THE PREFERRED EMBODIMENTS

Figure 1:
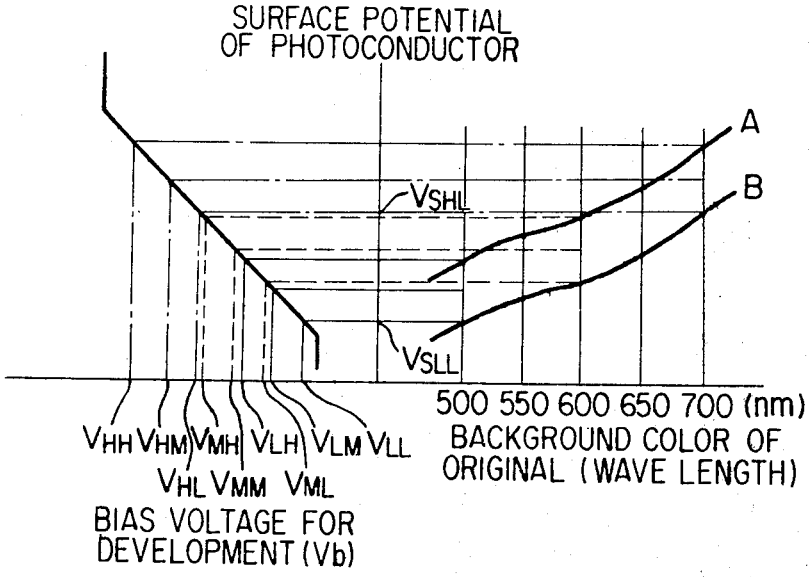
FIG. 1 is an explanatory graph in which photoconductor surface potential is plotted against both background color of the original and the appropriate developing bias voltage.

The essential part of the present invention will be outlined first. As is well known, the surface voltage on the photosensitive body varies in dependence upon both the color and the relative light and shade—or density—of the background or nonimage or non-information portion of the original. When selenium forms the photosensitive body surface and a fluorescent lamp provides the source of light for illuminating the original, for example, the surface voltage present on the photosensitive body after exposure and corresponding to both the color and density of the background of the original is a function of the synergetic property of the spectral sensitivity of the photosensitive body and the spectral sensitivity of the illuminating light source, and a relationship like that shown in FIG. 1 is obtained. In the graph of FIG. 1, the curve A represents a plot of background color versus photoconductor surface potential where the original has a relatively dark or dense background, while curve B represents such a plot where the original has a lighter or less dense background. As should be clear, even for a fixed or constant background density (for example, curve B), the surface voltage $V_S$ on the photosensitive body is different (for example, $V_{SLL}$ and $V_{SHL}$) for different background colors or wavelengths (for example, wavelengths of 500 mm and 700 nm), and it is understood that copied images with consistently stable copy quality cannot be obtained unless a developing bias voltage for obtaining a copied image with appropriate contrast is established at correspondingly different voltages (for example, $V_{LL}$ and $V_{HL}$). The present invention therefore provides control of the developing bias voltage based on determinations of both the color of the background of the original and its density.

In FIG. 2, the exposure device for the original to be copied is utilized as a light projecting device 4. Additional details of construction of the copying machine are not shown since they are well known and the present invention can be applied to any copying machines. In the particular FIG. 2 example, the color sensor or second detecting means 51 (e.g., semiconductor color sensor PB-150.PB-151j of Sharp Electronics Co.) for detecting the color of the background of the original, and the optical sensor or first detecting means 52 for the density of the background of the original, are both arranged at a portion of the main frame of the machine which is located under the copy board 2 and out of the light path for the copying operation; as there shown, the light emanating from projecting device 4 is reflected from the edge portion of the original 3—at which edge portion only the background (and not the image or information to be reproduced) is generally present—onto the sensors or detecting means 51 and 52.

Second detecting means 51, on which the light reflected from original 3 on copy board 2 falls, outputs a signal proportional to or dependent upon the specific wavelength or color of the background of the original, and first detecting means 52 provides an output corresponding to the density of the background. It is thus possible, with such information, to detect both the color or wavelength and the relative density of the background of the original and, based upon these detected signals, to electrically determine and control the magnitude of appropriate bias voltage to be supplied, for example, to a magnetic brush developing device or the like.

Figure 2A:
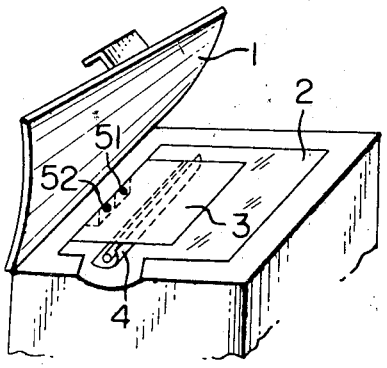
FIGS. 2A and 2B are a partial perspective view and a partial side view, respectively, of an apparatus constructed in accordance with the present invention.
Figure 2B:
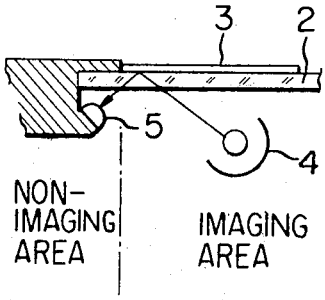

FIGS. 2A and 2B illustrate, in relevant part, a desirable mode of implementation where the copying machine construction incorporates projection scanning with a reciprocating copy board. In such a construction, a correct determination of appropriate developing bias voltage is virtually assured because color and density of the entire edge surface of the original can be detected even if the sensors or detecting means 51, 52 are fixed at the lower position of the copy board. In an apparatus having instead a movable optical system and wherein the sensors are similarly so fixed, on the other hand, an appropriate developing bias voltage might not be obtained because only a part of the original is detected. To avoid this problem, it is necessary that the sensing means move together with the optical system and the light source. Nevertheless, since originals to be copied rarely have backgrounds divided into two or more zones of different colors, there would likely be no actual problem even were the sensing means maintained at a fixed position on the main frame rather then arranged for movement with the light source or optical system.

Figure 3:
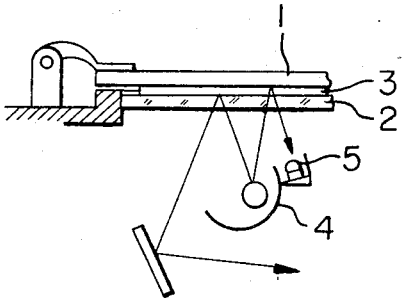
FIG. 3 is a partial side view of another apparatus in accordance with the invention.

FIG. 3, like FIG. 2, illustrates an apparatus wherein the exposure means for the original is also used as a light projecting device 4. As shown, the sensors (there jointly designated by the reference numeral 5) are mounted on a portion of the reflection mirror assembly (no reference symbol) of light projecting device 4. This construction can be utilized in copying machines incorporating either copy board reciprocation (wherein the copy board alternately moves to the right and to the left in the drawing) or original projection device reciprocation (wherein light throwing device 4 and sensing means or detectors 5 alternatingly move in tandem to the right and left in the drawing) in the copying operation.

Figure 4:
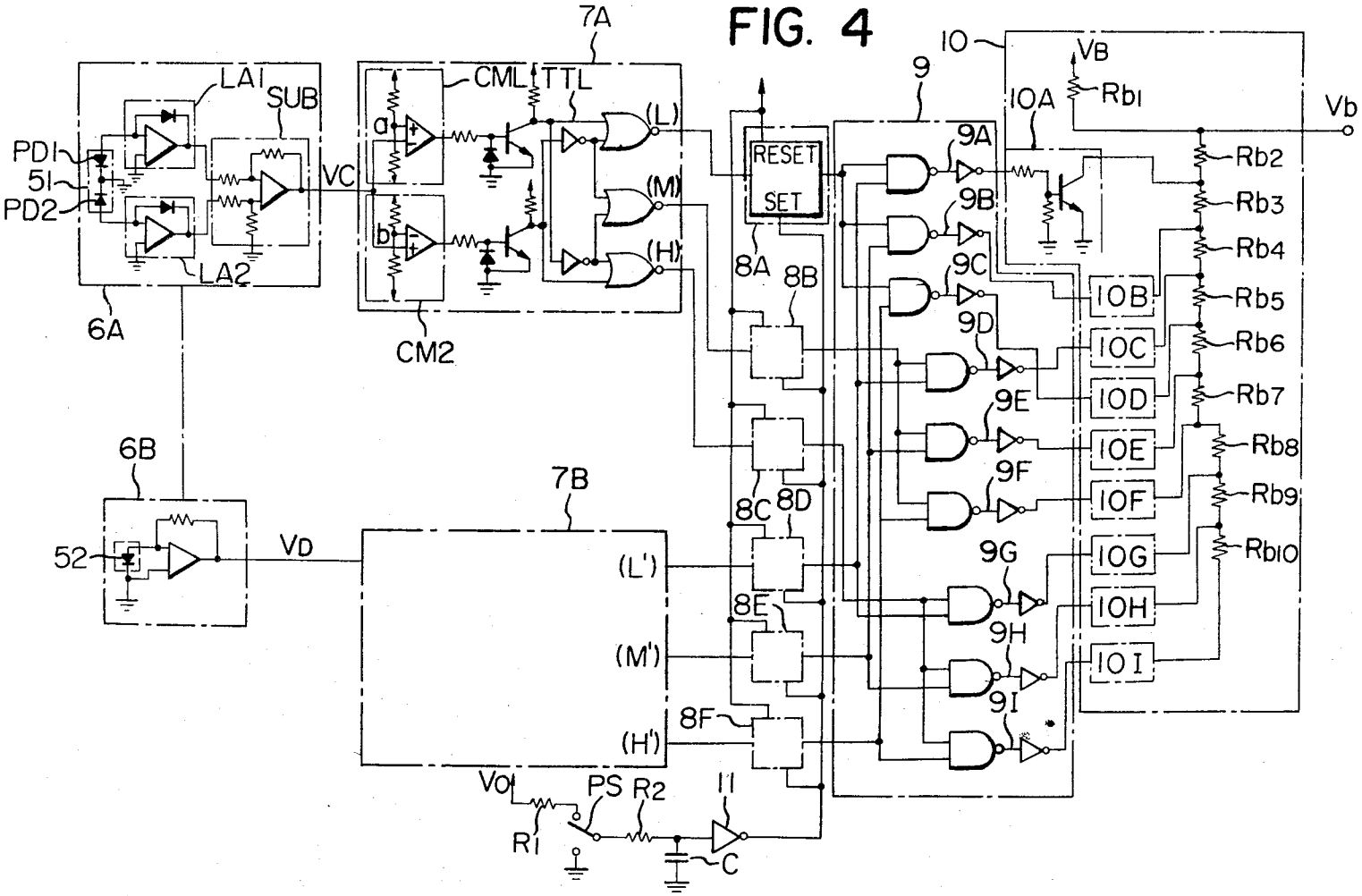
FIG. 4 is a semi-schematic circuit diagram showing an implementation of the invention.
Figure 5:
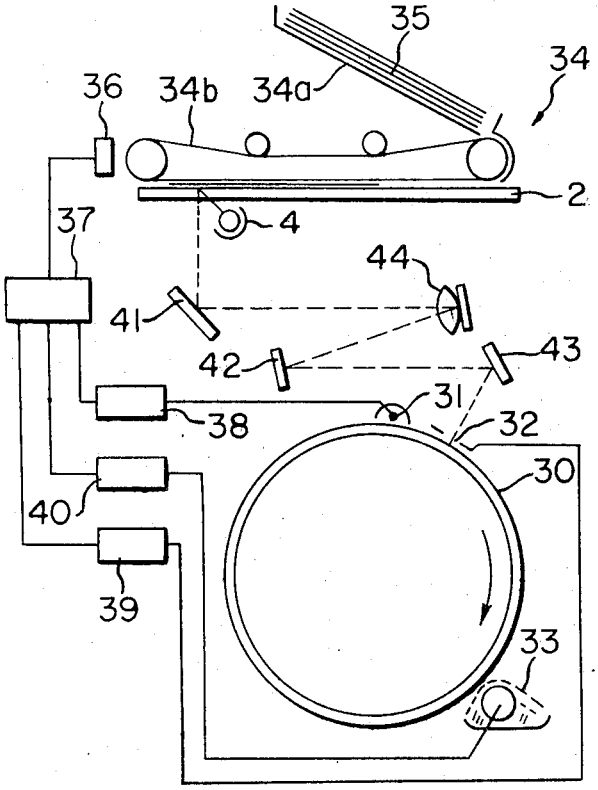

By utilizing the circuit shown in FIG. 4 for the color sensor 51 and the density sensor 52 as in FIGS. 2A, 2B or FIG. 3, selection of a developing bias voltage that is suitable for the original being copied is rendered possible. A conventional magnetic brush type developing device of well known construction wherein magnets are radially arranged within an electrically conductive sleeve to which the developing bias voltage is applied may conveniently be used in accordance with the present invention.

As shown in FIG. 1, the full range of background colors may be divided into 3 regions or steps (by way of convenient example, steps of L=550 nm and less, M=550–650 nm, and H=650 nm and over), and the range of background densities also divided or classified into 3 steps (L, M, and H); this arrangement will be used herein for purposes of explanation, although more or fewer divisions could be provided in practice. All originals are thereby classifiable into one of 9 categories and a suitable developing bias voltage can be selected for each original on the basis of $V_{LL}<V_{LM}<V_{ML}<V_{LH}<V_{MM}<V_{MH}<V_{HL}<V_{HM}<V_{HH}$, as seen in FIG. 1. The original may naturally be classified more finely or roughly and these conditions may be established in accordance with the spectral sensitivity of the copying machine as a system.

In FIG. 4, numerals 6A and 6B respectively designate the second (color) sensor unit and the first (density) sensor unit, 7A and 7B are the level discrimination circuits for discriminating the output levels from sensors 6A and 6B, respectively, numerals 8A–8F indicate latch circuits for latching the various outputs of level discrimination circuits 7A and 7B, unit 9 is a selection logic circuit, and part 10 is a developing bias voltage selection circuit.

In second sensor unit 6A, the outputs of two photodiodes PD1 and PD2 having different spectral sensitivities and contained in second detecting means 51 are logarithmically compressed by logarithmic amplifiers LA1 and LA2 and then fed to subtraction circuit SUB. The output voltage $V_C$ of circuit SUB is independent of the intensity of the incident light and proportional to its wavelength. That is, $$V_C \propto \text{Log } I_{SC2} - \text{Log } I_{SC1} = \text{Log } (I_{SC2}/I_{SC1})$$

wherein $I_{SC1}$ and $I_{SC2}$ are the respective output currents of photodiodes PD1 and PD2.

Level discrimination circuits 7A and 7B each have the same circuit composition, circuit 7A receiving from second sensor unit 6A the voltage $V_C$ that is proportional to the detected wavelength and outputting a signal on one of its output terminals (L), (M) or (H) in accordance with the magnitude of voltage $V_c$ developed from the wavelength of reflected light incident on second detecting means 51.

In level discrimination circuit 7A, output voltage $V_C$ of second sensor unit 6A is inputted to the (−) input terminal of a comparison amplifier CM1 and to the (+) input terminal of a comparison amplifier CM2. A voltage "a" corresponding to a first predetermined wavelength (e.g. 550 nm) is inputted to the (+) input of amplifier CM1 for comparison with voltage $V_C$, and a voltage "b" corresponding to a second predetermined wavelength (e.g. 650 nm) is inputted to the (−) input terminal of amplifier CM2 for comparison with voltage $V_C$. Amplifier CM1 outputs a signal of high level when $V_C<a$ (that is, the detected wavelength is less than 550 nm) and outputs a signal of low level when $V_C>a$ (that is, the detected wavelength is greater than 550 nm); amplifier CM2 outputs a low level signal when $V_C<b$ (that is, the detected wavelength is less than 650 nm)

and outputs a high level signal when $V_C > b$ (that is, the detected wavelength is greater than 650 nm). These output signals of comparison amplifiers CM1 and CM2 are processed by a transistor circuit and then fed to logic circuit TTL, generating the signals shown in Table 1 at output terminals (L), (M) and (H).

TABLE 1

| Input voltage | Output terminal (L) | Output terminal (M) | Output terminal (H) |
|---|---|---|---|
| $V_C < a$ | H | L | L |
| $a < V_C < b$ | L | H | L |
| $V_C > b$ | L | L | H |

H represents a high level signal and L represents a low level signal.

On the other hand, the density discrimination sensor unit 6B develops a voltage $V_D$ proportional to the background density of the original and level discrimination circuit 7B outputs the signals shown in Table 2 at its output terminals (L'), (M') and (H') in accordance with the background density in the same manner described in connection with circuit 7A.

TABLE 2

| Input voltage | Output terminal (L') | Output terminal (M') | Output terminal (H') |
|---|---|---|---|
| $V_C < a'$ | H | L | L |
| $a' < V_C < b'$ | L | H | L |
| $V_C > b'$ | L | L | H |

Once again, the voltages a' and b' are predetermined standard voltages dividing the background density into 3 steps.

When the output signals of level discrimination circuits 7A and 7B are inputted to selection logic circuit 9 through latch circuits 8A–8F, logic circuit 9 operates developing bias voltage selection circuit 10 to control the developing bias voltage $V_b$ on the basis of said signal information. The operation of selection logic circuit 9 will now be explained.

In order to simplify the explanation, discussion of the operation of circuit 9 will be limited to an instance in which the original placed on the copy board has a background color wavelength of 500 nm and its density corresponds to that characterized by curve A in FIG. 1; here, the appropriate developing bias voltage for copying this original is $V_{LH}$. In the case of this original, only output terminal (L) of circuit 7A and output terminal (H') of circuit 7B yield high level signals while the other terminals of circuit 7A and 7B each output low level signals. Those skilled in the art will readily recognize in FIG. 4 that when these signals are inputted to selection logic circuit 9 through latch circuits 8A–8F, only the output of logic circuit 9C presents a high level signal while the other logic circuits 9A, 9B, and 9D–9I each output low level signals.

Thus, the combination of output signals of selection logic circuit 9 corresponding to the particular color and density of the background of any given original is as shown in Table 3.

TABLE 3

| Background of original: Kind of color (Wave length) | Density of color | Output signal of selection logic circuit 9A | 9B | 9C | 9D | 9E | 9F | 9G | 9H | 9I |
|---|---|---|---|---|---|---|---|---|---|---|
| Less than | Low | H | L | L | L | L | L | L | L | L |

TABLE 3-continued

| Background of original: Kind of color (Wave length) | Density of color | Output signal of selection logic circuit 9A | 9B | 9C | 9D | 9E | 9F | 9G | 9H | 9I |
|---|---|---|---|---|---|---|---|---|---|---|
| 550 nm | Medium | L | H | L | L | L | L | L | L | L |
| | High | L | L | H | L | L | L | L | L | L |
| 550–650 nm | Low | L | L | L | H | L | L | L | L | L |
| | Medium | L | L | L | L | H | L | L | L | L |
| | High | L | L | L | L | L | H | L | L | L |
| 650 nm and over | Low | L | L | L | L | L | L | H | L | L |
| | Medium | L | L | L | L | L | L | L | H | L |
| | High | L | L | L | L | L | L | L | L | H |

On the basis of this output signal, selection of the appropriate developing bias voltage $V_b$ is performed by ON-OFF switching of switching transistors 10A–10I of developing bias voltage selection circuit 10.

Latch circuits 8A–8F are so constructed and interconnected as to hold or latch the outputs of level discrimination circuits 7A and 7B until a reset signal is applied to their terminals RESET. As seen in FIG. 4, when platen cover 1 (FIGS. 2 and 3) is closed, a platen cover switch PS is connected to power source $V_0$ whereby a condenser C is charged through resistors R1 and R2. The charged voltage of condenser C is fed to the set terminals SET of latch circuits 8A–8F through an inverter 11 as a falling pulse so that high level signals inputted from terminals (L), (M), (H), (L'), (M') and (H') of circuits 7A and 7B hold the signals and maintain their status. When platen cover 1 is subsequently opened (as to remove the original being copied), platen cover switch PS is grounded to discharge condenser C and thereby impress—through inverter 11—a rising pulse signal on set terminals SET of latch circuits 8A–8F; thus, reset of latch circuits 8A–8F is enabled by the rise of the pulse from inverter 11. Reset of latch circuits 8A–8F can be effected by a completion signal generated when a copying operation is finished. In order to effect reset of the latch circuits by the rising pulse of inverter 11, reset terminals RESET and set terminals SET should be common.

As a consequence of this construction of latch circuits 8A–8F, an appropriate developing bias voltage $V_b$ continues to be supplied so long as reset signals are not applied to the reset terminals RESET—even if generation of the output signals from the color and density sensors ceases during the copying operation (in the apparatus shown in FIGS. 2 and 3) or if the outputs signals are generated with the reciprocating motion of the sensors (as in FIG. 3).

By application of the teachings of the present invention, an appropriate developing bias voltage can be readily and reliably obtained for any original. As described, the developing bias voltage is selected on the basis of two signals generated, respectively, by a color sensor unit that detects the wavelength or color of the background of the original and a density discrimination sensor unit that detects the density of that background.

Although the present invention is explained with respect to selection of the developing bias voltage, it should nevertheless be understood that the application of its teachings need not be so limited and it can be otherwise applied satisfactorily to, for example, selection of the length or the intensity of light employed during exposure. Moreover, control of the bias voltage can also be applied to a cascade type developing device having an electrode for receiving a bias voltage.

What is claimed is:

1. In a copying machine for reproducing an original to be copied having an image and a background area thereon, and including means for projecting light on the original to be copied, and first detecting means for receiving light reflected from the background portion of the original and for producing a signal in accordance with the density of the light reflected from the background portion of the original, the improvement comprising second detecting means for receiving light reflected from the background portion of the original and for producing a signal in accordance with the wavelength of the light reflected from the background portion of the original, and level discriminating means for receiving the signals produced by said first and second detecting means and for controlling reproduction of the original in accordance with the wavelength and the density of the light reflected from the background portion of the original as represented by said signals of the first and second detecting means.

2. In a copying machine according to claim 1 wherein said machine further includes developing means to which a bias voltage is applied in the reproduction of an original, means connected with said level discriminating means for producing a bias voltage output based upon the signals of said first and second detecting means for impression upon the developing means so as to control the reproduction of the original on the basis of the wavelength and the density of light reflected from the background portion of the original.

* * * * *